US011787075B1

(12) United States Patent
Yang et al.

(10) Patent No.: US 11,787,075 B1
(45) Date of Patent: Oct. 17, 2023

(54) FOLDABLE ENVIRONMENTALLY FRIENDLY RAZOR

(71) Applicant: Tree Island International Inc., Fenyuan Township, Changhua County (TW)

(72) Inventors: Jia-Huey Yang, Fenyuan Township (TW); Yu-En Hung, Fenyuan Township (TW); Yu-Lun Hung, Fenyuan Township (TW); Yuan-Tung Hung, Fenyuan Township (TW)

(73) Assignee: TREE ISLAND INTERNATIONAL INC., Fenyuan Township (TW)

( * ) Notice: Subject to any disclaimer, the term of this patent is extended or adjusted under 35 U.S.C. 154(b) by 0 days.

(21) Appl. No.: 17/887,161

(22) Filed: Aug. 12, 2022

(30) Foreign Application Priority Data

Jul. 21, 2022 (TW) ..... 111127302

(51) Int. Cl.
*B26B 21/00* (2006.01)
*B26B 21/52* (2006.01)

(52) U.S. Cl.
CPC ..... *B26B 21/528* (2013.01); *B26B 21/00* (2013.01)

(58) Field of Classification Search
CPC ..... B26B 21/528; B26B 21/00; B26B 21/52
USPC ..... 30/526, 32
See application file for complete search history.

(56) References Cited

U.S. PATENT DOCUMENTS 3,750,280 A * 8/1973 LePaliscot ..... B26B 21/523 30/526
4,985,994 A * 1/1991 Tavolieri ..... B26B 21/523 30/526
5,027,510 A * 7/1991 Bodtke ..... B26B 21/06 30/32
5,033,191 A * 7/1991 Nauheimer ..... B26B 21/06 30/47
5,274,922 A * 1/1994 Elliott ..... B26B 21/16 30/47
6,571,476 B1 * 6/2003 Bickers ..... B26B 21/14 30/526

* cited by examiner

*Primary Examiner* — Phong H Nguyen
(74) *Attorney, Agent, or Firm* — Birch, Stewart, Kolasch & Birch, LLP

(57) ABSTRACT

A foldable environmentally friendly razor includes: a flat sheet with an opening at one end and a blade at the opening. The flat sheet is provided with two main folding lines extending from one end toward the other, so that a main supporting portion is formed between the two main folding lines. Two holding portions are respectively formed between the main folding lines and both sides of the flat sheet. A first folding line joins the ends of two main folding lines. Two blade face folding lines extend respectively and diagonally towards opposing left and right sides of the flat sheet from the respective junctions of the first folding line and the main folding lines, so that the two blade face folding lines and the first folding line enclose a blade face. The two holding portions and the main supporting portion form a columnar structure to provide better support.

9 Claims, 12 Drawing Sheets

FOLDABLE ENVIRONMENTALLY FRIENDLY RAZOR

BACKGROUND OF THE INVENTION

1. Field of the Invention

The present invention is related to razors, in particular to a foldable environmentally friendly razor.

2. Description of the Related Art

In order to provide hygienic and convenient cleaning equipment for guests, many hotels or homestays will prepare disposable toiletries for guests, such as razors. This type of razor is mostly made of plastic, although it is very convenient and cheap, but plastic is not an environmentally friendly material, so a lot of use will cause great environmental problems.

SUMMARY OF THE INVENTION

The main purpose of the present invention is to provide a foldable environmentally friendly razor made of environmentally friendly materials.

To achieve the above main purpose of the present invention, the foldable environmentally friendly razor includes: a flat sheet with an opening at one end and a blade at the opening. The flat sheet is provided with two main folding lines extending from one end toward the other, so that a main supporting portion is formed between the two main folding lines. Two holding portions are respectively formed between the main folding lines and both sides of the flat sheet. A first folding line joins the ends of two main folding lines. Two blade face folding lines extend respectively and diagonally towards opposing left and right sides of the flat sheet from the respective junctions of the first folding line and the main folding lines, so that the two blade face folding lines and the first folding line enclose a blade face, and the opening is in the blade face.

With the above structure, the flat sheet of the present invention can be folded into a three-dimensional paper razor for use. Not only is it easy to store and carry, but also the two holding portions can be close to each other to form a triangular-shaped column structure with the main supporting portion to form a stable grip, which can provide better support and grip of the foldable environmentally friendly razor during use.

Preferably, the flat sheet is made of environmentally friendly materials, which can be recycled, so the damage to the environment can be reduced.

Preferably, a support member is added to the main supporting portion. The support member is a flat sheet with a middle fold line in the middle. Two lugs are respectively protruded on each of both sides of the support member. The support member is folded with the middle fold line, so that the cross section of the support member is V-shaped. The lugs are correspondingly inserted into the notches of the main supporting portion, so that the support member is installed in the main supporting portion, so that the two holding portions can sandwich the support member when they are folded together.

DETAILED DESCRIPTION OF THE INVENTION

Figure 1:
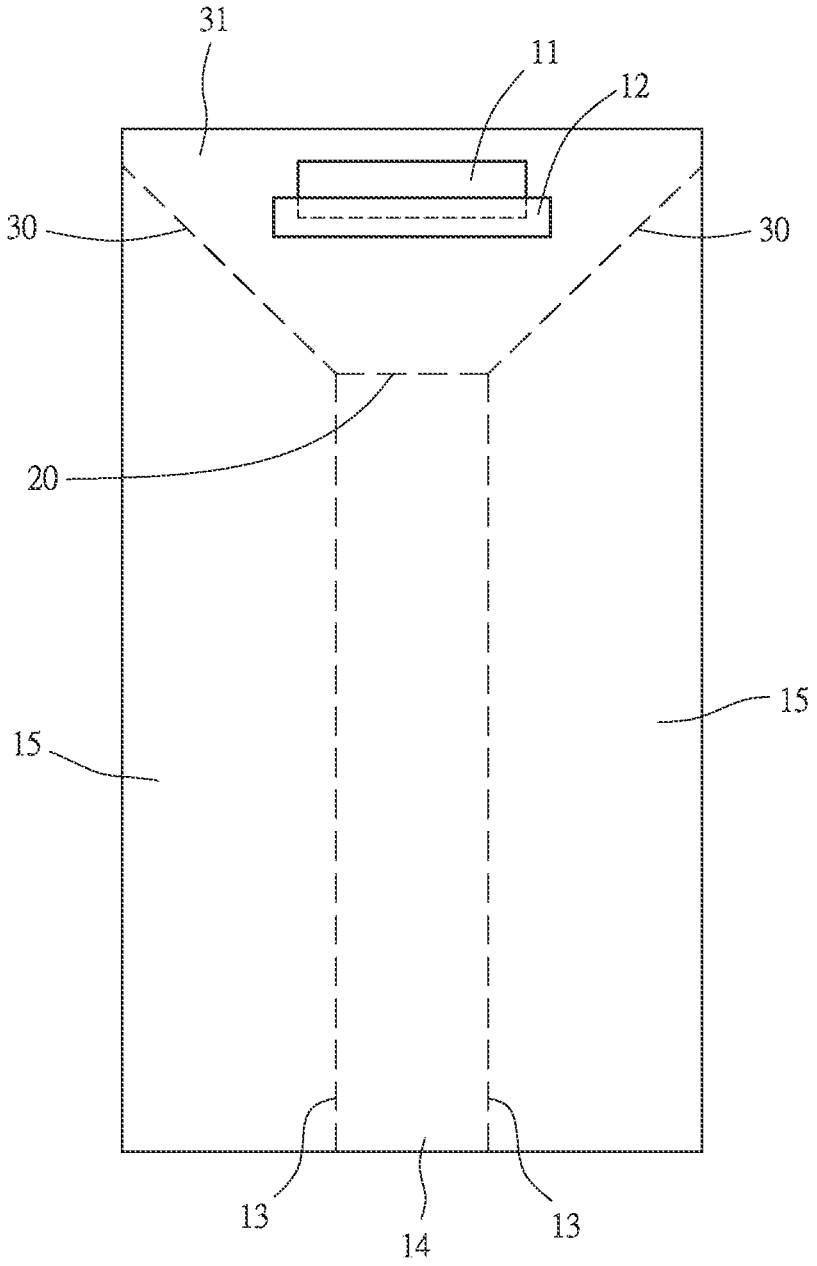
FIG. 1 is a schematic plan view of a first embodiment of the present invention.

The applicant first explains that in the entire specification, including the embodiments described below and the claims of the scope of the patent application, the terms related to the directionality are based on the directions in the drawings. Next, in the embodiments and drawings to be introduced below, the same element numbers represent the same or similar elements or their structural features. The directions indicated in the specification are the directions of the drawings for the convenience of description and are not limited thereto.

Figure 2:
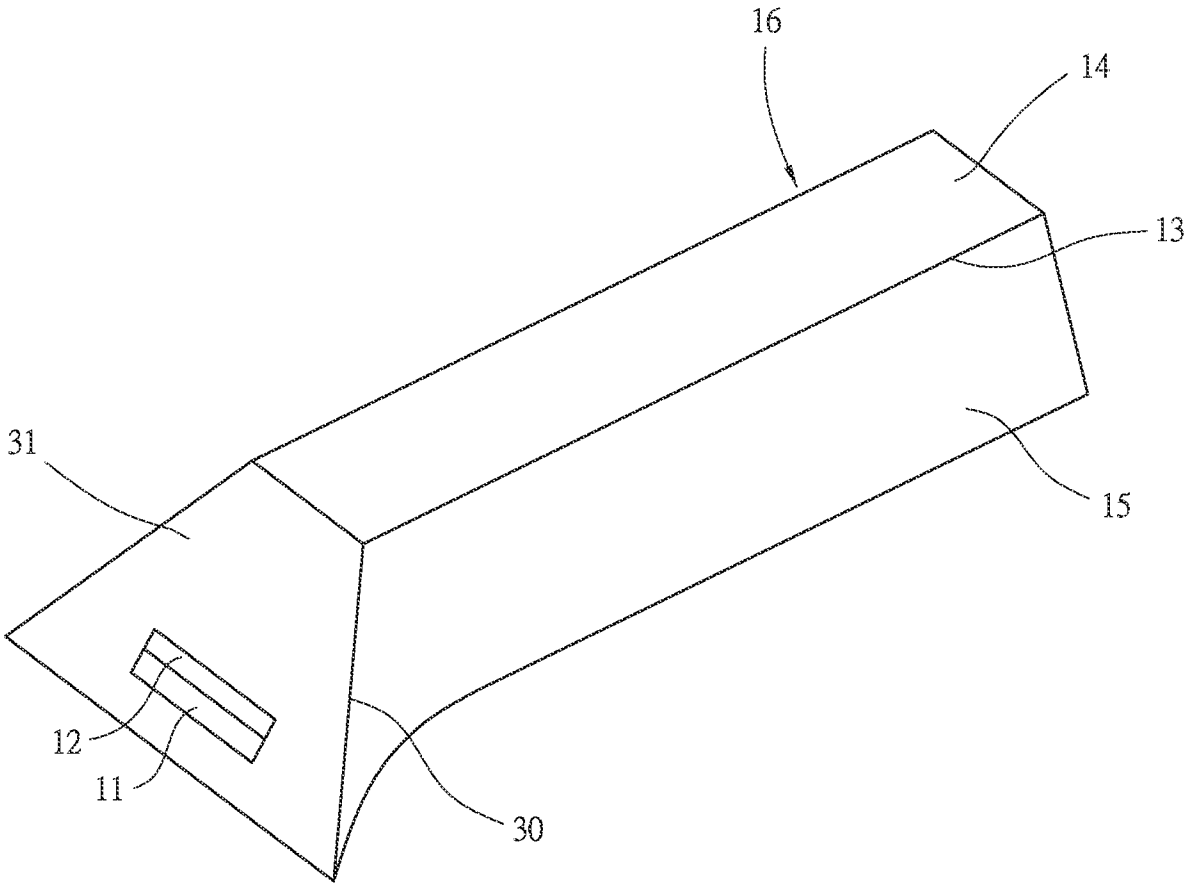
FIG. 2 is an oblique top elevational view of the first embodiment of the present invention.
Figure 3:
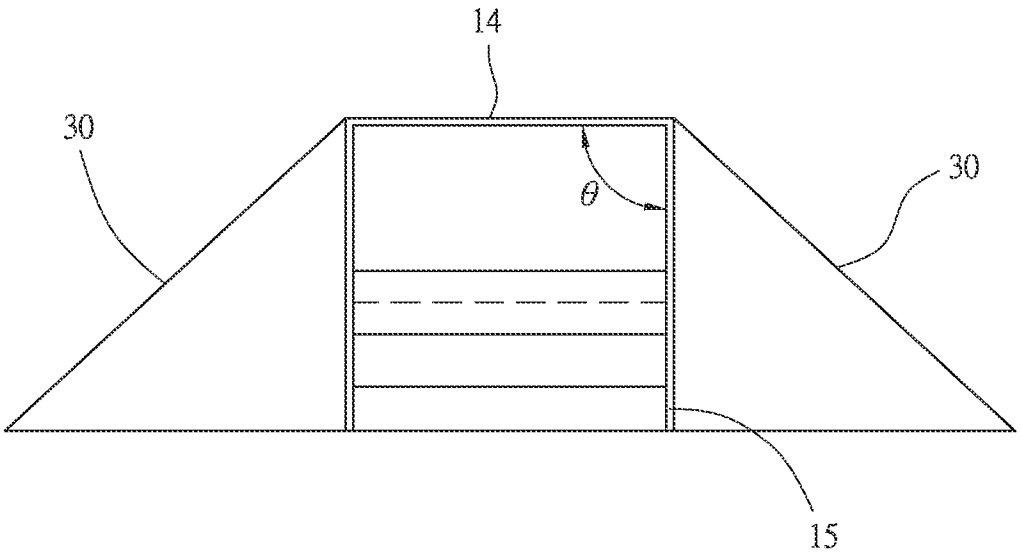
FIG. 3 is an end view of the right side of the first embodiment of the present invention.

Referring to FIGS. 1-3, in the first embodiment of the present invention, the foldable environmentally friendly razor of the present invention is made by folding a sheet of flat material. The foldable environmentally friendly razor comprises a flat sheet 10. In this example, the sheet is a cardboard, which is elongated, but not limited to this. For the convenience of description, this embodiment uses the direction of the drawing as the direction to define top, bottom, left, and right. An opening 11 is provided at the top end of the flat sheet, a blade 12 is provided at the opening. Two main folding lines 13 are provided on the flat sheet. The two main folding lines 13 extend from the bottom end of the flat sheet 10 toward the top end direction, so that a main supporting portion 14 is formed between these two main folding lines 13. The two main folding lines 13 preferably extend in parallel, so that the main supporting portion forms a flat wall plane of a long rectangle. A holding portion 15 is formed between any main folding line 13 and the left side or right side of the flat sheet.

A first folding line 20 is arranged at the extended ends of the two main folding lines 13, and the first folding line 20 connects the ends of the two main folding lines 13.

Two blade face folding lines 30 extend diagonally toward the upper left and the upper right of the flat sheet 10 from the junction of the first folding line 20 and one of the main folding lines 13 respectively, so that the two blade face folding lines 30 and the first folding line 20 enclose a blade face 31, and the opening 11 is in the blade face 31.

With the structure of the first embodiment of the present invention, the flat sheet 10 is in the shape of a flat plate when not in use, as shown in FIG. 1, so the volume is very small, which is very conducive to storage and carrying. The volume of the transported material can also be reduced to a minimum during the transportation process. The user only needs to fold the two holding portions 15 in the same direction along the two main folding lines 13 towards the flat sheet 10, and fold the blade face 31 in the same direction along the two blade face folding lines 30. In this embodiment, the blade face 31 and the two holding portions 15 are folded toward the direction of passing through the paper surface. In this way, a long main supporting portion 14 like a beam can be formed between the two main folding lines 13. The folded corners formed by the holding portions 15 and the main supporting portion 14 at the two main folding lines 13 can avoid the left-right torsion of the main supporting portion 14. The two blade face folding lines 30 and the first folding line 20 can form an inclined blade face 31. Thereby, the flat sheet can be folded into a three-dimensional paper razor for use, and the user can hold the holding portions 15 and use the blade to shave.

When the included angle θ between the two holding portions 15 and the main supporting portion 14 is less than or equal to 90 degrees, the main supporting portion 14 can have a better supporting effect. The best state is that the two holding portions 15 can be close to each other to form a columnar structure with a triangular cross-section with the main supporting portion 14 to form a stable grip 16, which can provide better support and grip of the foldable environmentally friendly razor during use.

Figure 4:
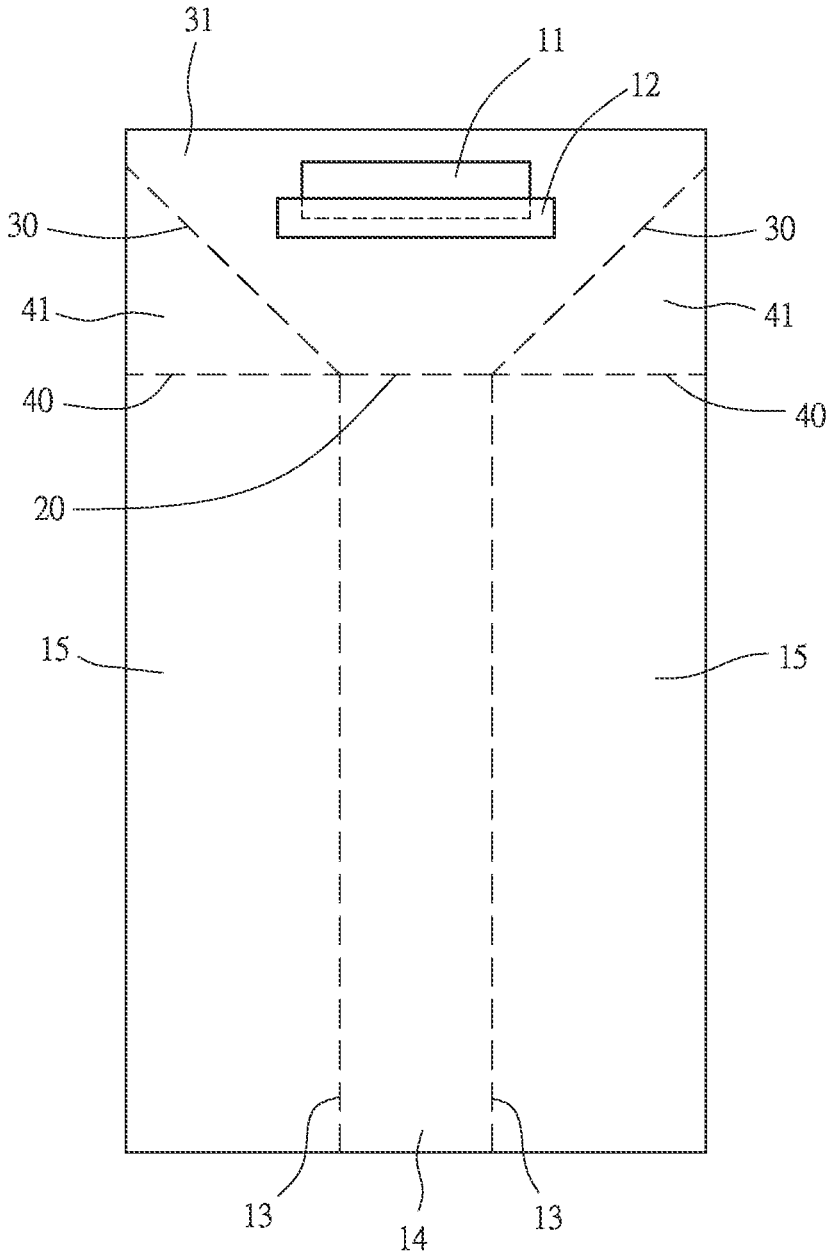
FIG. 4 is a schematic plan view of a second embodiment of the present invention.
Figure 5:
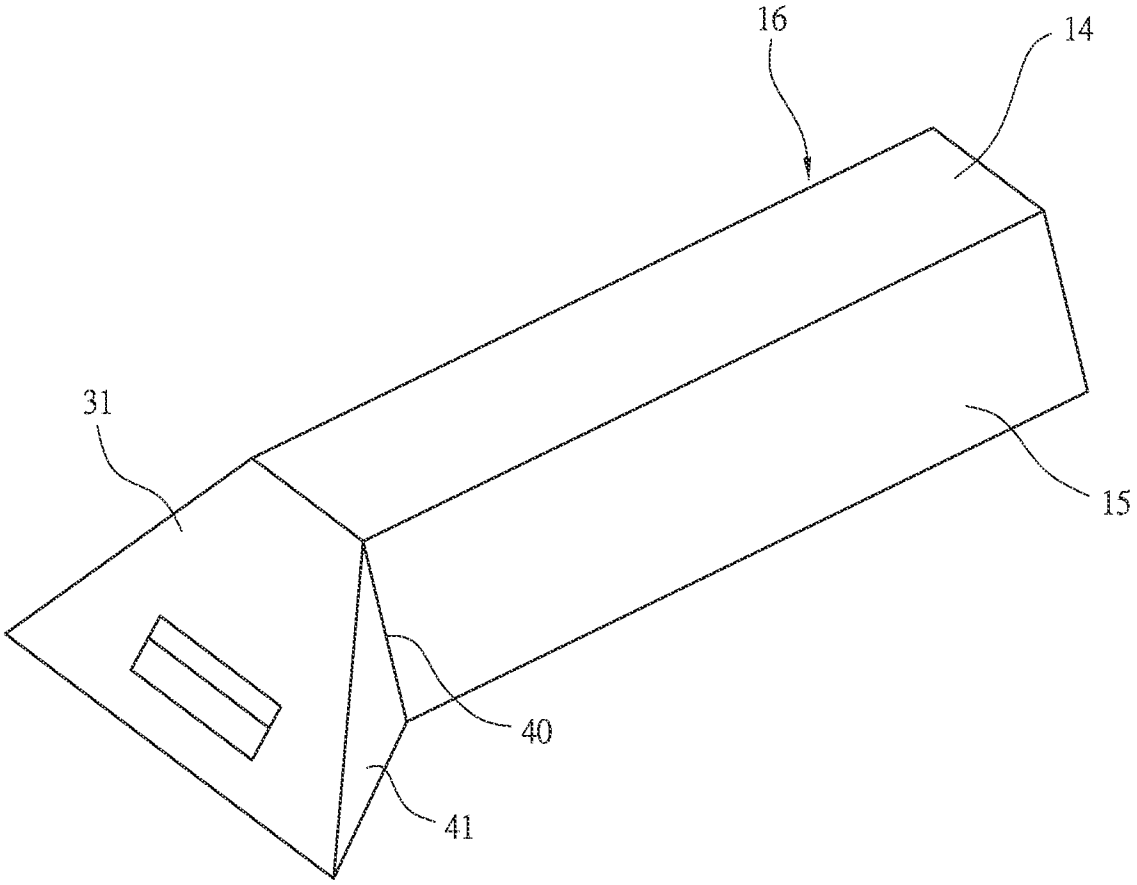
FIG. 5 is an oblique top elevational view of the second embodiment of the present invention.

As shown in FIG. 4 and FIG. 5, it is the second embodiment of the present invention. In this embodiment, the foldable environmentally friendly razor comprises a flat sheet 10. In this example, the sheet is a cardboard, which is elongated, but not limited to this. For the convenience of description, this embodiment uses the direction of the drawing as the direction to define top, bottom, left, and right. An opening 11 is provided at the top end of the flat sheet, a blade 12 is provided at the opening. Two main folding lines 13 are provided on the flat sheet. The two main folding lines 13 extend from the bottom end of the flat sheet 10 toward the top end direction, so that a main supporting portion 14 is formed between the two main folding lines 13. The two main folding lines 13 preferably extend in parallel, so that the main supporting portion forms a flat wall plane of a long rectangle. A holding portion 15 is formed between any main folding line 13 and the left side or right side of the flat sheet.

A first folding line 20 is arranged at the extended ends of the two main folding lines 13, and the first folding line 20 connects the ends of the two main folding lines 13.

Two blade face folding lines 30 extend diagonally toward the upper left and the upper right of the flat sheet 10 from the junction of the first folding line 20 and one of the main folding lines 13 respectively, so that the two blade face folding lines 30 and the first folding line 20 enclose a blade face 31, and the opening 11 is in the blade face 31. The difference from the previous embodiment is that in the present embodiment, two auxiliary folding lines 40 are respectively extended toward the left and right sides of the flat sheet 10 from the junctions of the two main folding lines 13 and the first folding line 20, and a lateral portion 41 is formed between each of the holding portions 15 and the blade face 31. Using the two lateral portions 41 and the blade face 31 can make the structure of the razor on the blade face 31 more stable and less deformed. The two auxiliary folding lines 40 may extend left and right along the direction of the first folding line 20, or extend diagonally upward or diagonally downward.

Figure 6:
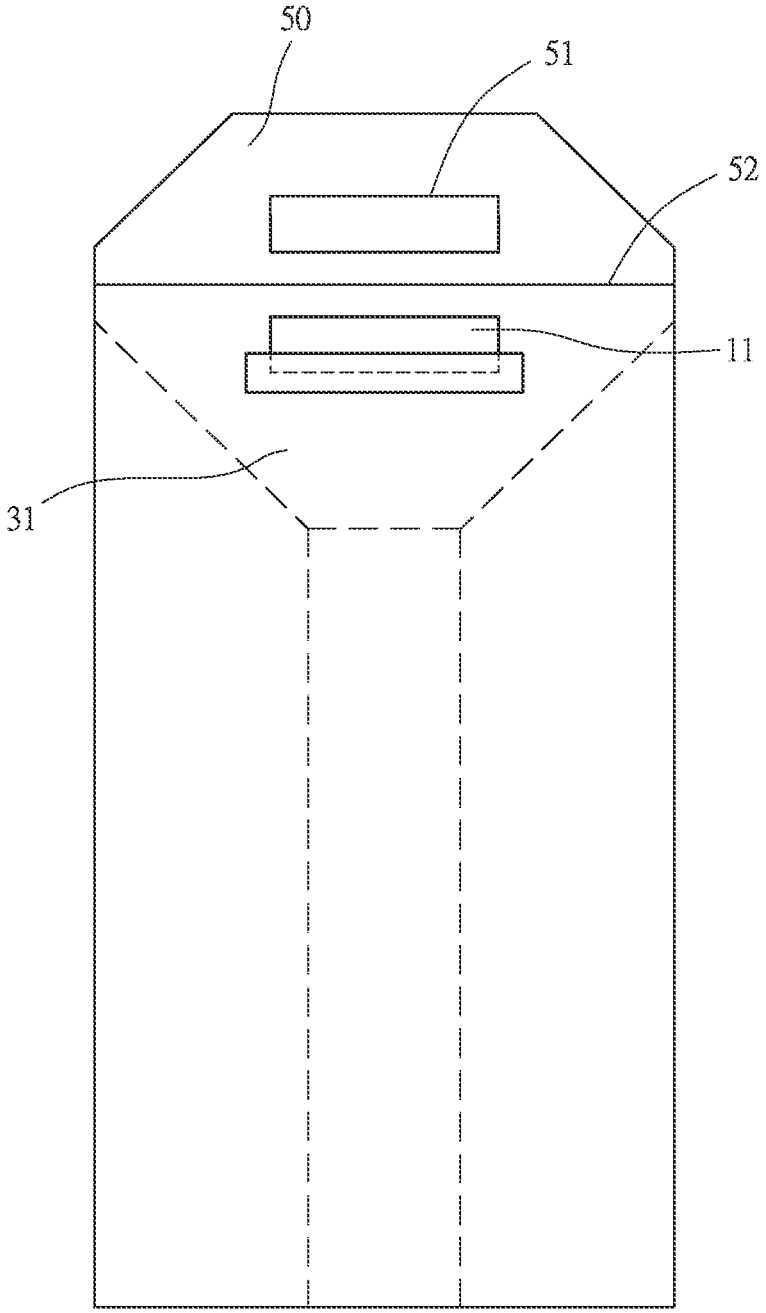
FIG. 6 is a schematic plan view of a third embodiment of the present invention.
Figure 7:
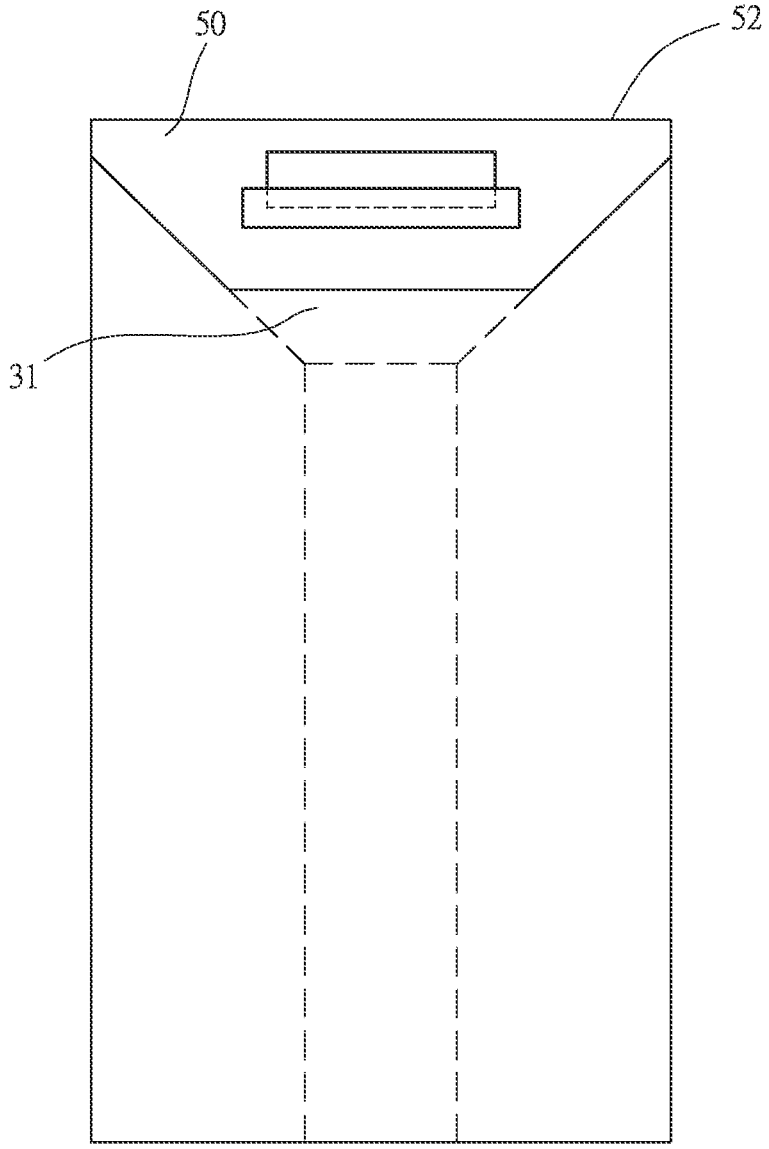
FIG. 7 is a schematic plan view of the third embodiment of the present invention, showing the state after the reinforced portion is folded back.

As shown in FIG. 6 and FIG. 7, it is the third embodiment of the present invention, except that the present invention has the same structure as the first embodiment, a reinforced portion 50 is extended on the blade face. The reinforced portion is integrally extended outward from the blade face 31. Between the reinforced portion 50 and the blade face 31 there is a reverse fold line 52. The area of the reinforced portion 50 may be equal to or smaller than the blade face. The reinforced portion is provided with an opening 51. The reinforced portion 50 can be folded along the reverse fold line 52 to overlap the blade face 31 and make the opening 51 correspond to the opening 11 of the blade face. Thereby, the thickness of the blade face 31 can be increased and the strength of the blade face 31 can be improved.

Figure 8:
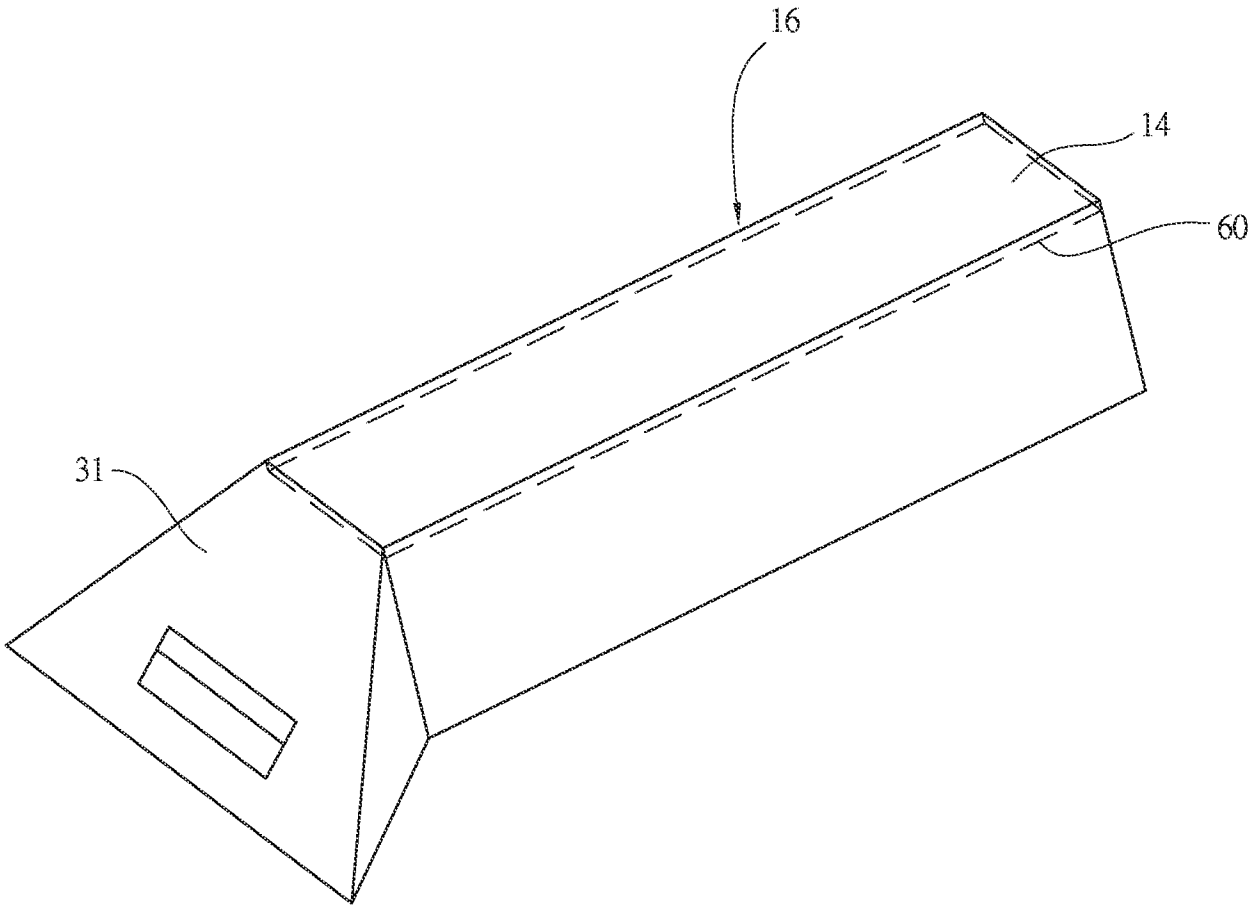
FIG. 8 an oblique top elevational view of a fourth embodiment of the present invention.
Figure 9:
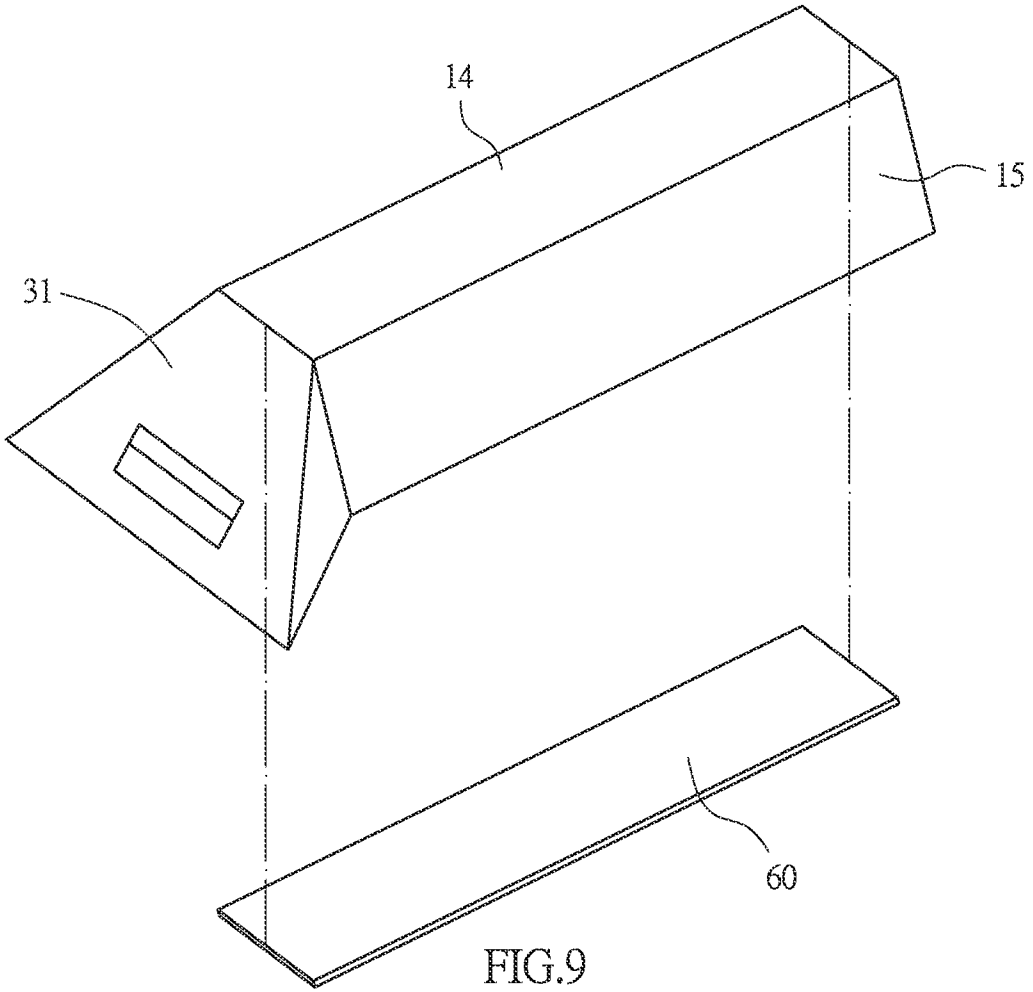
FIG. 9 is an exploded view of the fourth embodiment of the present invention.

As shown in FIG. 8 and FIG. 9, it is the fourth embodiment of the present invention. In addition to having the same structure as the second embodiment, the present invention further adds a support member 60 to the main supporting portion 14. In this embodiment, the support member 60 is a sheet, and its area can be equal to or smaller than the main supporting portion 14. The support member 60 is attached to the bottom surface or the top surface of the main supporting portion 14 to increase the thickness of the main supporting portion 14 and enhance the structural strength of the main supporting portion 14.

Figure 10:
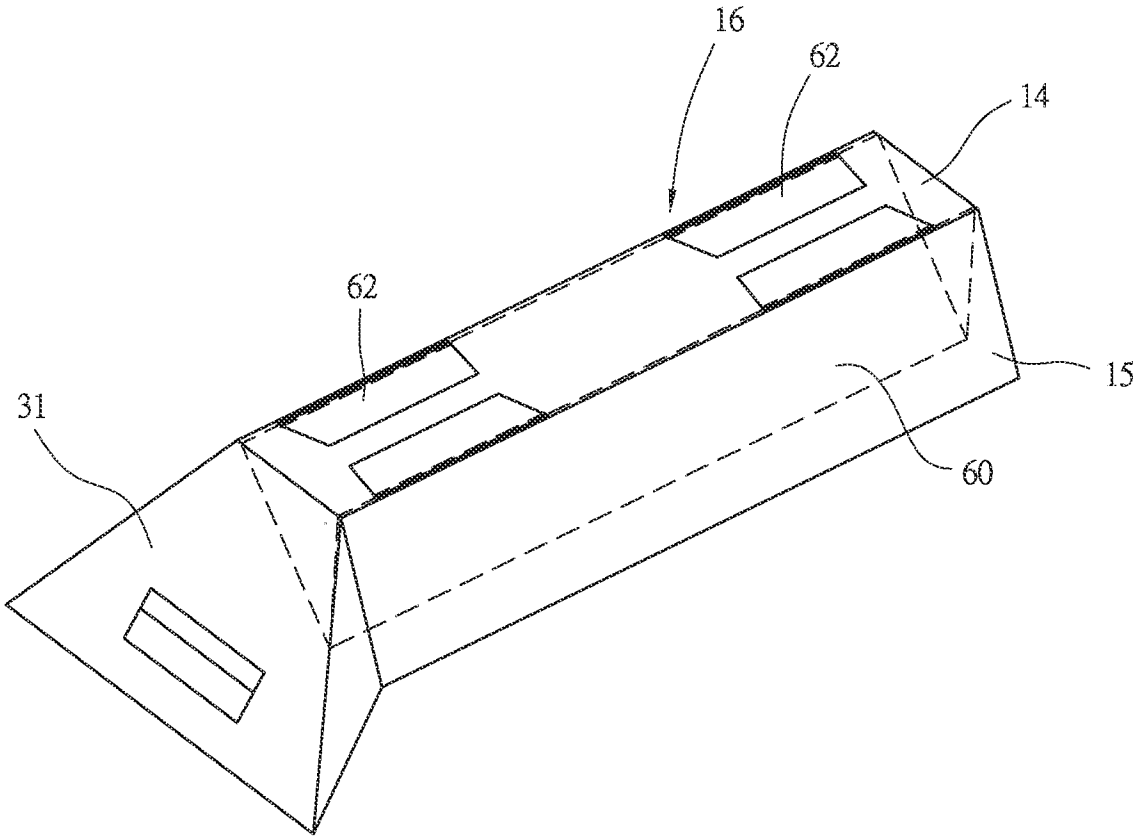
FIG. 10 is an oblique top elevational view of a fifth embodiment of the present invention.
Figure 11:
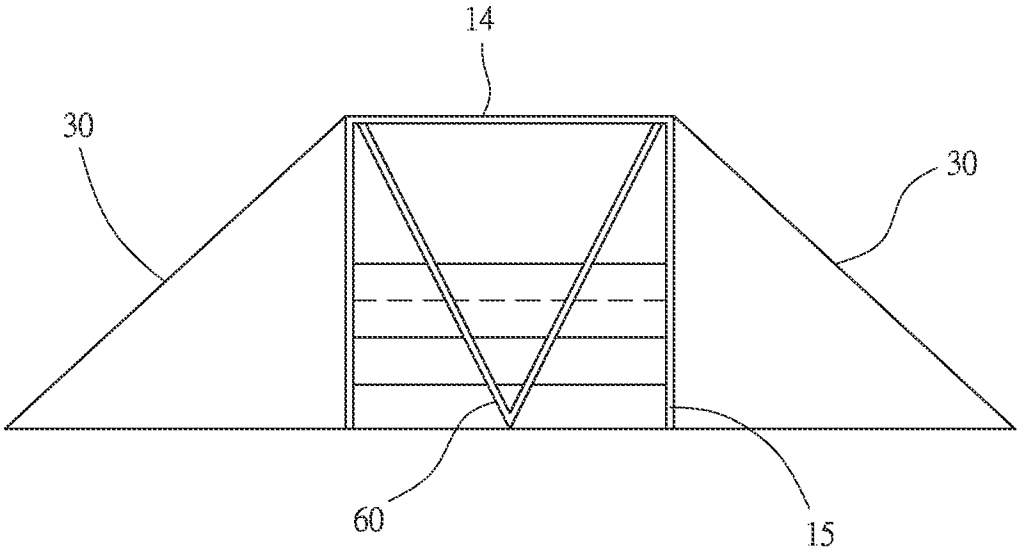
FIG. 11 is a right-side end view of the fifth embodiment of the present invention.
Figure 12:
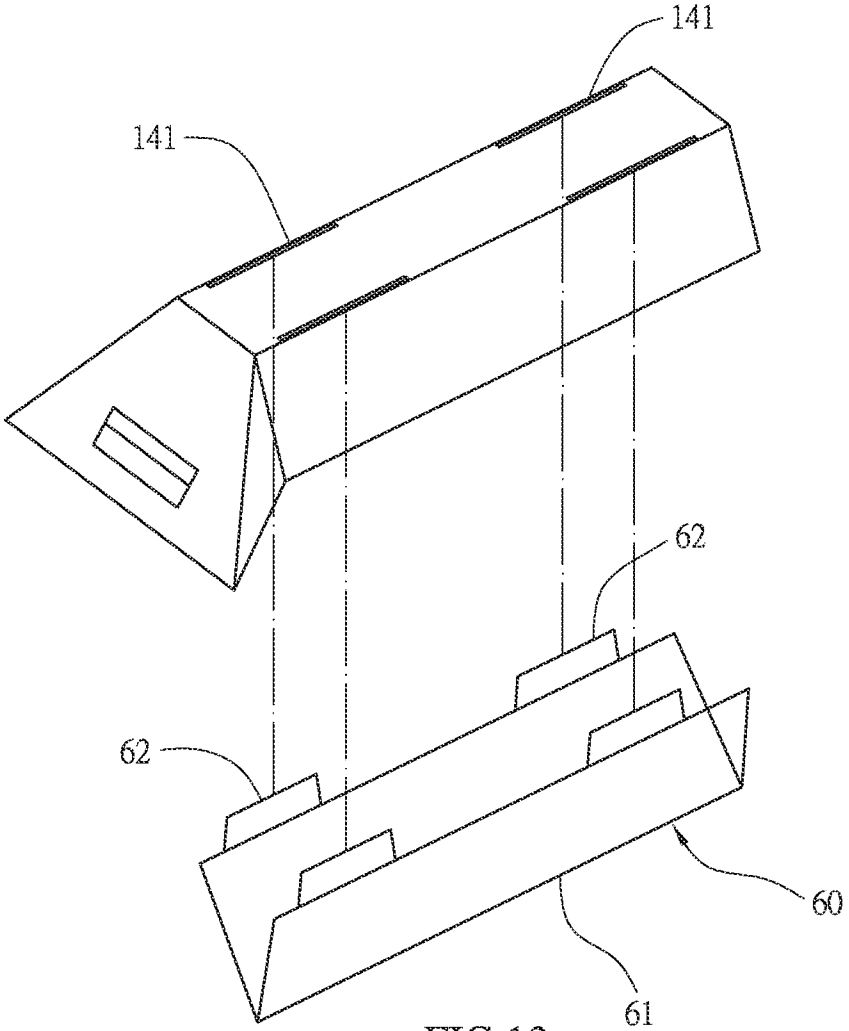
FIG. 12 is an exploded view of the fifth embodiment of the present invention.

As shown in FIGS. 10-12, it is the fifth embodiment of the present invention. In addition to having the same structure as the second embodiment, the present invention further adds a support member 60 to the main supporting portion 14. In this embodiment, the main supporting portion 14 is provided with four notches 141. The support member 60 is a sheet with a middle fold line 61 in the middle, and two lugs 62 are respectively protruded on each of both sides of the support member 60. When assembled and used, the folding method of the holding portions 15 and the blade face 31 is the same as that of the second embodiment. The support member 60 is folded with the middle fold line 61, so that the cross section of the support member 60 is V-shaped, and then the lugs 62 are inserted into the notches 141 of the main supporting portion, as shown in the drawings. Then fold down the part where the lugs 62 pass through the notches 141. In this way, the support member 60 can be mounted on the main supporting portion 14, so that when the two holding portions 15 are folded close together, the support member 60 can be sandwiched, so that the thickness of the triangular columnar structure originally formed by the two holding portions 15 and the main supporting portion 14 can be increased, and the strength of the grip 16 can be increased.

In this embodiment, the four notches 141 are divided into two groups along the two main folding lines 13, but the number is not limited to this, and can also be set according to the length or requirements of the grip.

What is claimed is:

1. A foldable environmentally friendly razor, comprising:

a flat sheet, one end of said flat sheet being provided with an opening, said opening being provided with a blade, said flat sheet being provided with two main folding lines, said two main folding lines extending from one end of said flat sheet toward an opposite end of said flat sheet so that a main supporting portion is formed between said two main folding lines and two holding portions are respectively formed between said two main folding lines and two opposite lateral sides of said flat sheet;

a first folding line set at the extension ends of said two main folding lines, said first folding line connecting the ends of said two main folding lines;

two blade face folding lines extending respectively and diagonally towards opposing left and right sides of said flat sheet from the respective junctions of said first folding line and said main folding lines, so that said two blade face folding lines and said first folding line enclose a blade face, and said opening is in said blade face; and two auxiliary folding lines respectively extended toward the left and right sides of said flat sheet from the junctions of said two main folding lines and said first folding line, so that a lateral portion is formed between each of said holding portions and said blade face.

2. The foldable environmentally friendly razor as claimed in claim 1, wherein the included angle between said two holding portions and said main supporting portion is less than or equal to 90 degrees.

3. The foldable environmentally friendly razor as claimed in claim 2, wherein said two holding portions are close to each other to form a columnar structure with a triangular cross-section with said main supporting portion to form a grip.

4. The foldable environmentally friendly razor as claimed in claim 1, further comprising a support member, said support member being a sheet, the area of said support member being equal to or smaller than said main supporting portion, said support member being attached to said main supporting portion to increase the thickness of said main supporting portion.

5. The foldable environmentally friendly razor as claimed in claim 1, further comprising a support member, said support member being a sheet, the area of said support member being equal to or smaller than said main supporting portion, said support member being attached to said main supporting portion to increase the thickness of said main supporting portion.

6. The foldable environmentally friendly razor as claimed in claim 1, wherein said main supporting portion is provided with a plurality of notches and said main supporting portion is attached with a support member, said support member being a flat plate with a middle fold line in the middle, said support member having two sides thereof respectively protruded with a plurality of lugs corresponding to said notches of said main supporting portion, said support member being folded with said middle fold line, so that the cross section of said support member is V-shaped, said lugs being inserted in said notches of said main supporting portion in one-to-one correspondence, so that said two holding portions sandwich said support member when folded together.

7. The foldable environmentally friendly razor as claimed in claim 6, wherein the included angle between said two holding portions and said main supporting portion is less than or equal to 90 degrees.

8. The foldable environmentally friendly razor as claimed in claim 7, wherein said two holding portions are close to each other to form a columnar structure with a triangular cross-section with said main supporting portion to form a grip.

9. A foldable environmentally friendly razor, comprising:

a flat sheet, one end of said flat sheet being provided with an opening, said opening being provided with a blade, said flat sheet being provided with two main folding lines, said two main folding lines extending from one end of said flat sheet toward an opposite end of said flat sheet so that a main supporting portion is formed between said two main folding lines and two holding portions are respectively formed between said two main folding lines and two opposite lateral sides of said flat sheet;

a first folding line set at the extension ends of said two main folding lines, said first folding line connecting the ends of said two main folding lines; and two blade face folding lines extending respectively and diagonally towards opposing left and right sides of said flat sheet from the respective junctions of said first folding line and said main folding lines, so that said two blade face folding lines and said first folding line enclose a blade face, and said opening is in said blade face, wherein said main supporting portion is provided with a plurality of notches and said main supporting portion is attached with a support member, said support member being a flat plate with a middle fold line in the middle, said support member having two sides thereof respectively protruded with a plurality of lugs corresponding to said notches of said main supporting portion, said support member being folded with said middle fold line, so that the cross section of said support member is V-shaped, said lugs being inserted in said notches of said main supporting portion in one-to-one correspondence, so that said two holding portions sandwich said support member when folded together.

* * * * *